US005797687A

United States Patent [19]

Petersen et al.

[11] Patent Number: 5,797,687

[45] Date of Patent: Aug. 25, 1998

[54] PAPER STACKER ACTIVATION FOR PRINTER INPUT/OUTPUT

[75] Inventors: David M. Petersen, Poway; Jeremy Mayer, San Diego; Scott M. Nakada, Oceanside, all of Calif.

[73] Assignee: Hewlett-Packard Company, Palo Alto, Calif.

[21] Appl. No.: 814,564

[22] Filed: Mar. 11, 1997

[51] Int. Cl.[6] ..... B41J 3/28; B41J 11/20

[52] U.S. Cl. ..... 400/23; 400/58; 400/625; 347/104; 347/220

[58] Field of Search ..... 400/104, 23, 34, 400/48, 625, 578, 58; 347/104, 220

[56] References Cited

U.S. PATENT DOCUMENTS

| | | | |
|---|---|---|---|
| 3,874,493 | 4/1975 | Boyd | 400/48 |
| 4,024,942 | 5/1977 | Kawaji | 400/34 |
| 5,000,591 | 3/1991 | Burgess | 400/58 |
| 5,291,224 | 3/1994 | Asano et al. | 347/104 |
| 5,506,606 | 4/1996 | Saikawa et al. | 347/104 |
| 5,547,292 | 8/1996 | Harada | 400/58 |
| 5,673,074 | 9/1997 | Miyauchi et al. | 347/104 |
| 5,683,187 | 11/1997 | Tunmore | 400/58 |
| 5,684,516 | 11/1997 | Cseledy et al. | 347/104 |
| 5,700,099 | 12/1997 | Kobayashi et al. | 400/625 |

*Primary Examiner*—Eugene H. Eickholt

[57] ABSTRACT

A printer with paper stacker activation. A platen is mounted on the drive roller for both rotation and translation. When fully to the right end of its travel, the platen is engaged with rotation stops which position the platen a fixed distance from the print cartridge, and disengaged from the roller, which can rotate for paper advancement during printing. When translated to the left, the platen is disengaged from the rotation stops and allowed to rotate. A clockwise rotation of the drive roller brings a roller shoulder into contact with a platen tab, urging the platen downwardly, clearing the way for the paper to fall into the output tray. Platen translation from right to left is driven by the carriage. A flag and a key are mounted on the roller, and engage the platen by the pen carriage. The key has a friction pinch on the roller, such that a torque is produced when the roller turns. The flag is adjacent the key, and the torque produced by the key urges rotation of the flag. The flag and key are constrained in rotation; when the roller rotates forward, the flag is lowered and will not engage the carriage. When the roller reverses, the flag is constrained to stop in a position which interferes with the carriage. Platen engagement occurs by driving the roller in reverse, rotating the flag into the pen carriage path, which then moves left, moving the platen.

17 Claims, 9 Drawing Sheets

FIG. 9
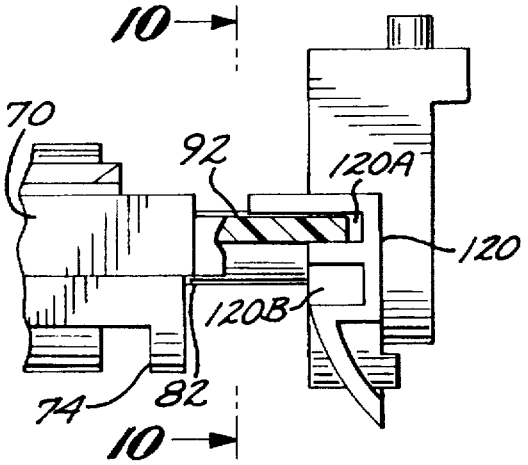
FIG. 10
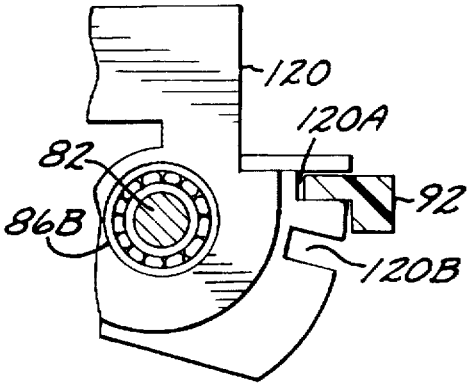
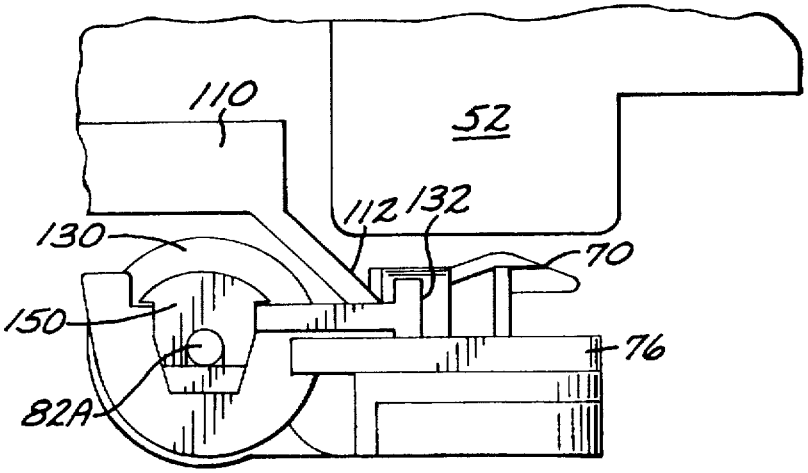
FIG. 11
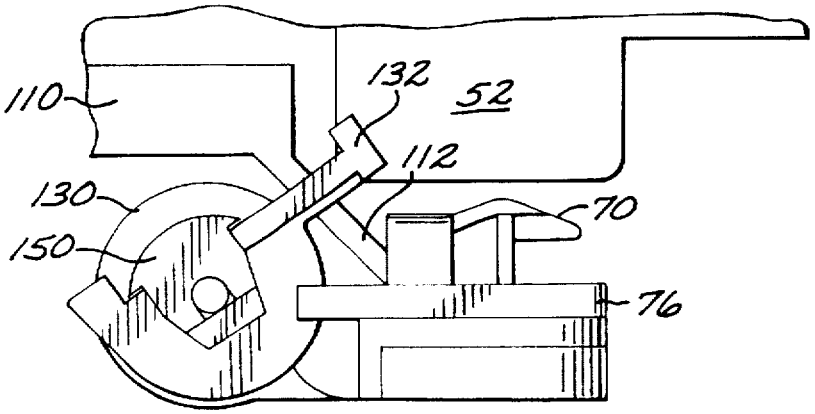
FIG. 12

FIG. 15
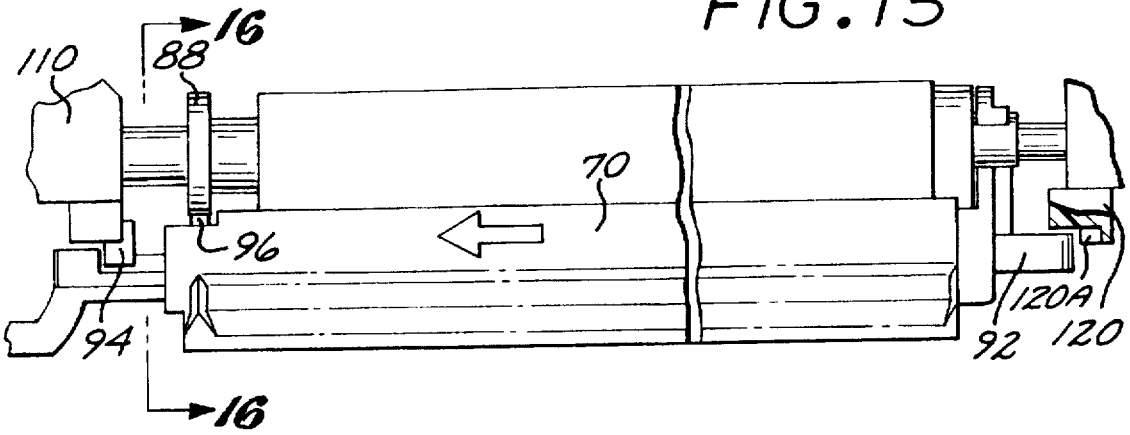
FIG. 16
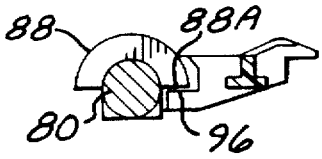
FIG. 17
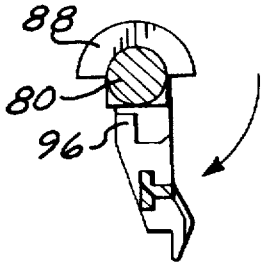
FIG. 18
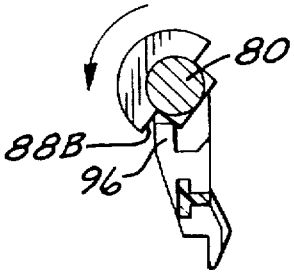
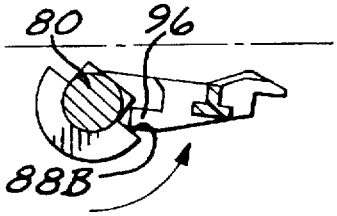
FIG. 19
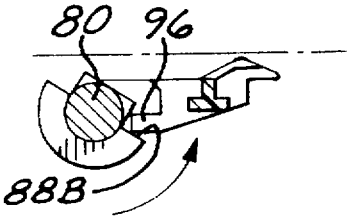
FIG. 20

PAPER STACKER ACTIVATION FOR PRINTER INPUT/OUTPUT

TECHNICAL FIELD OF THE INVENTION

This invention relates to printers, and more particularly to ink-jet printers having a paper stacker activation which allows the sharing of the paper drive and pen carriage drive systems to activate paper stacking without adding extra carriage travel or width to the printer.

BACKGROUND OF THE INVENTION

The Hewlett-Packard "DeskJet" family of printers have used end affected engagement of the paper drop system at the output of the printer. Activation occurs by moving the pen carriage to the extreme end of its travel where it pushes on a lever which causes the drive roller to engage with a rotatable platen. The drive roller then rotates forward, taking the platen with it, and rotating the platen down under the drive roller so that the paper can fall into the output tray. A key disadvantage of this system is the extra pen carriage travel which is needed to engage the platen with the drive roller. This travel adds to the overall width of the printer.

SUMMARY OF THE INVENTION

A printer is described with a stacker activation which overcomes the foregoing disadvantages. The printer platen is mounted on the drive roller shaft for both rotation and translation along the shaft. When the platen is fully to the right end of its linear travel, it is engaged with rotation stops which rotationally position the platen a fixed distance from the print cartridge. In this position, the platen is fully disengaged from the drive roller, which is thereby free to rotate for paper advancement during printing. If the platen is translated to the left, it is disengaged from the rotation stops and allowed to rotate. A clockwise rotation of the drive roller brings a roller boss shoulder into contact with a tab on the platen. This urges the platen downwardly, eventually clearing the way for the paper to fall into the output tray.

Platen translation from the right to the left is driven by the pen carriage. The platen is spring preloaded to the right. Two additional parts, the flag and the key, are mounted on the drive roller shaft and used to engage the platen by the pen carriage. The key has a friction pinch on the drive roller shaft, such that a torque is produced in the direction of rotation whenever the drive roller rotates. The flag is adjacent the key, and the torque produced by the key acts to rotate the flag and key either forward or in reverse with the drive roller. The flag and key are constrained in the rotation such that when the drive roller rotates forward, the flag is lowered and will not engage the pen carriage. When the drive roller rotates backward, the flag is constrained to stop in a position which interferes with the pen carriage. The flag is rotationally free of the platen, but translationally interlocked with it. Platen engagement occurs by driving the drive roller in reverse, which rotates the flag into the path of the pen carriage. The pen carriage then moves left, moving the flag and platen. Translation stops when the platen tab encounters the shoulder on the drive roller.

BRIEF DESCRIPTION OF THE DRAWING

These and other features and advantages of the present invention will become more apparent from the following detailed description of an exemplary embodiment thereof, as illustrated in the accompanying drawings, in which:

FIG. 9 is a view of the right end of the platen, showing structure for holding the right edge of the platen in position.

FIG. 10 is a cross-sectional view taken along line 10—10 of FIG. 9.

FIG. 11 is an end view of the flag with the platen in a print position.

FIG. 12 is an end view of the flag with the flag rotated into position for engagement by the printer carriage to activate the paper stacking.

FIG. 15 is a simplified top view of the platen and roller assembly, showing the platen translated to the left.

FIG. 16 shows the platen and drive roller in crosssection, taken along line 16—16 of FIG. 15, prior to activation by the printer carriage.

FIGS. 17–20 are similar to FIG. 16, but show the platen and drive roller in sequential positions as the platen is activated.

DETAILED DESCRIPTION OF THE PREFERRED EMBODIMENT

Figure 1:
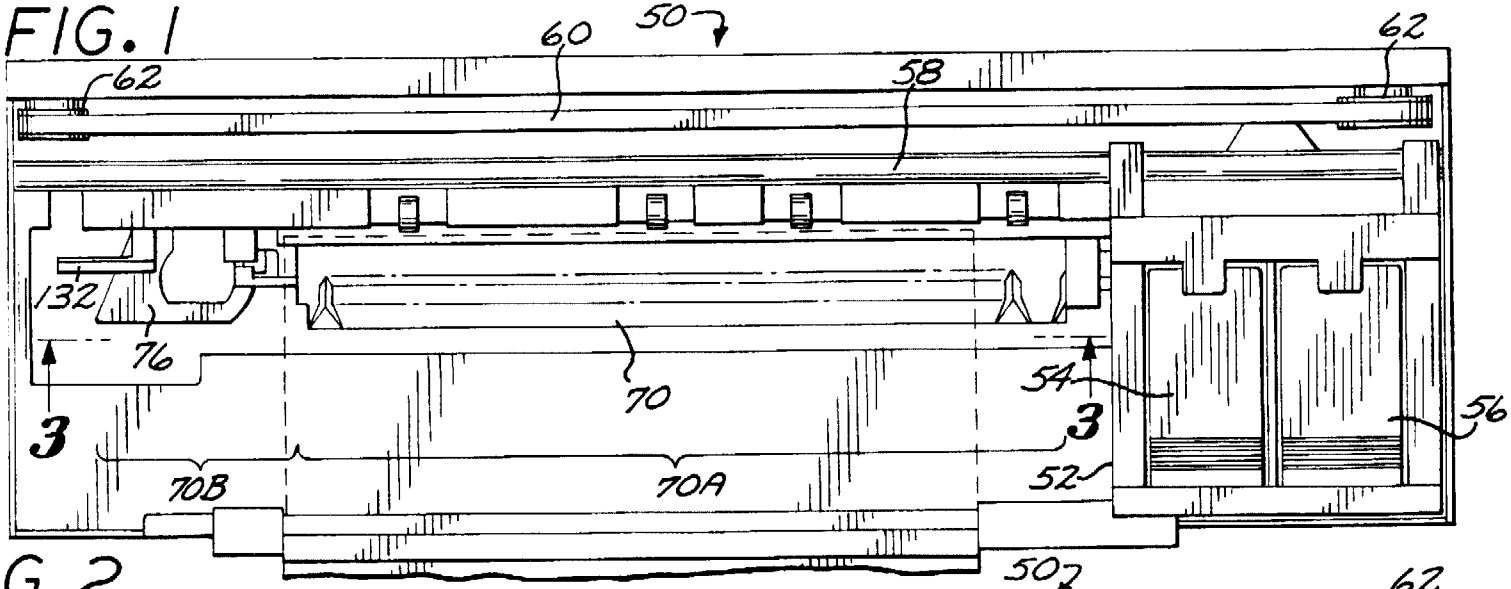
FIG. 1 is a top plan view of a portion of a printer embodying the invention, with the printer carriage at a right side of the printer.

FIG. 1 is a partial top view of an exemplary embodiment of a printer 50 embodying the invention. The printer has a scanning carriage 52 which carries two ink-jet pen cartridges 54, 56 of different ink colors above a print area. The carriage is mounted for sliding movement along a slider rod 58. A drive belt 62 is reeved about wheels 60, and is connected to a carriage drive motor and the carriage 52. The drive motor and drive belt provide a carriage drive apparatus for driving the carriage along a carriage swath. During printing operations, the pen cartridges are controlled to eject ink droplets in a controlled manner to record an image on a print medium such as paper disposed in the print area.

A movable platen structure 70 supports the print media at the print area during printing operations, and is movable in accordance with the invention after completion of printing operations to permit the paper/media to drop down into an output tray. The platen structure 70 includes a region whose lateral extent along the carriage scan axis is indicated as region 70A, which generally indicates the lateral extent of the active print area. To the left of region 70A is a second region 70B of the platen structure. As will be described more fully below, elements of the platen structure in region 70B are engaged to translate and rotate the platen structure during certain operations.

Figure 2:
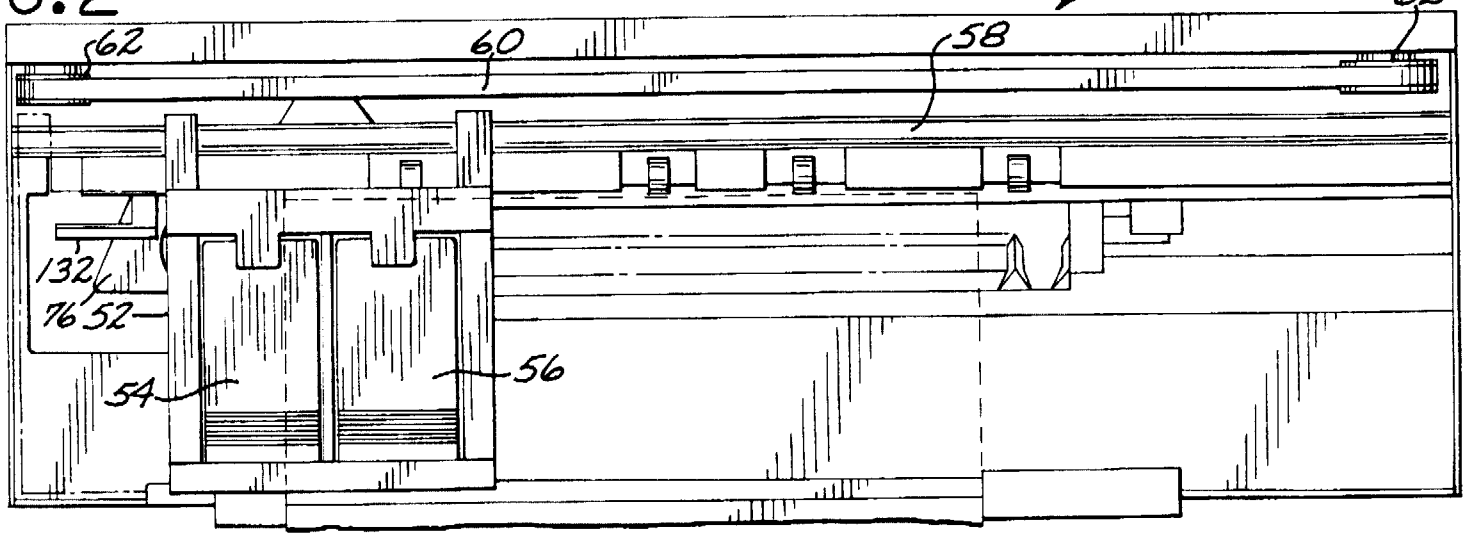
FIG. 2 is a top plan view similar to FIG. 1 but with the carriage moved to a left side of the printer.

The carriage 52 is shown adjacent a right limit position in its range of motion along the scan axis in FIG. 1. In FIG. 2, the carriage is shown positioned adjacent the left limit position in its range of motion.

Figure 3:
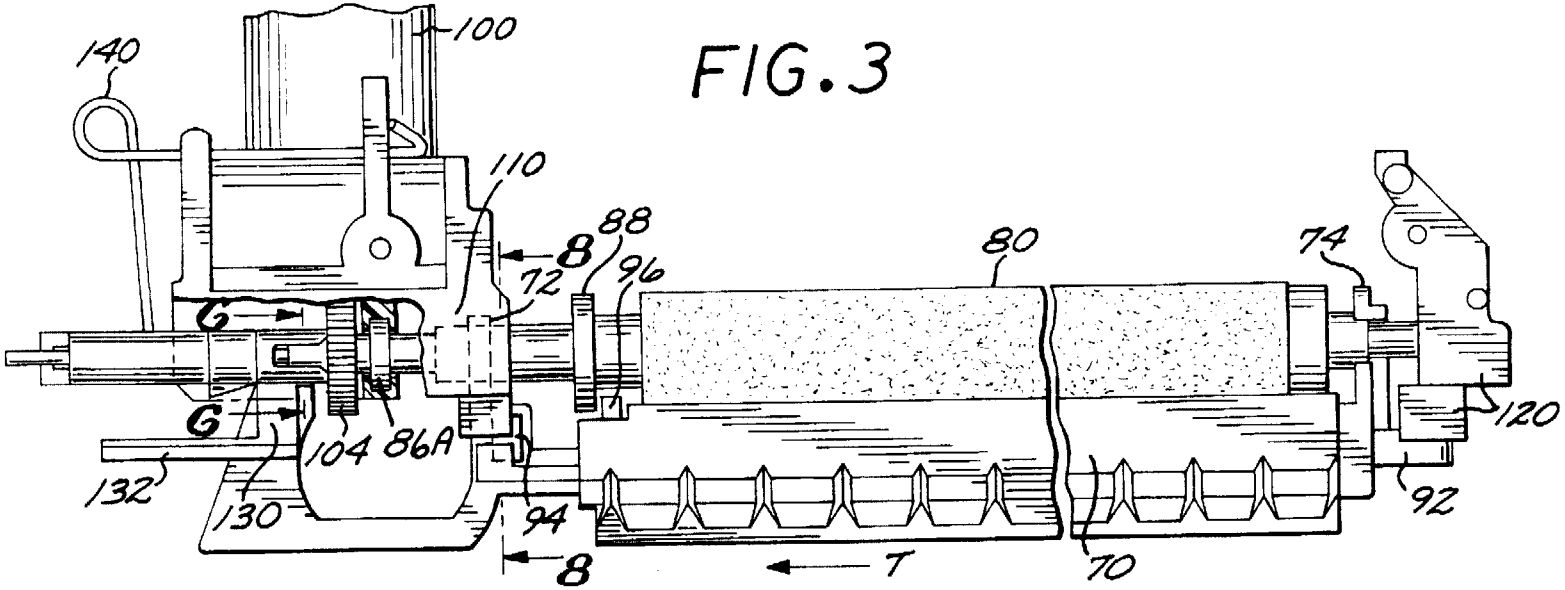
FIG. 3 is a top plan view taken from line 3—3 of FIG. 1, illustrating the motor drive and movable platen of the printer of FIG. 1.

To further illustrate the printer media drive system, FIG. 3 is a top view isolating on the drive roller 80, platen 70, motor drive and related elements. The roller drive motor 100 is connected to the roller shaft via a gear drive comprising worm gear 102 and shaft mounted gear 104. The motor is a dc motor in this exemplary embodiment, and can rotate the roller in the forward direction to drawn the media through the print zone during printing operations, and also in a reverse direction. The motor 100 is supported by fixed support structure 110 secured to a printer chassis. Other types of motors such as stepper motors can also be employed.

The platen 70 is shown in FIG. 3 in the print position. However, once the printing operations are completed on a sheet of print media, the system releases the sheet and drops it into an output tray (not shown in FIG. 3). As will be described in detail below, the printer includes apparatus for translating the platen to the left in FIG. 3, in the direction of arrow T, to release the platen and permit it to rotate about the axis of the drive roller downwardly, permitting the paper to drop down into the output tray.

Figure 8:
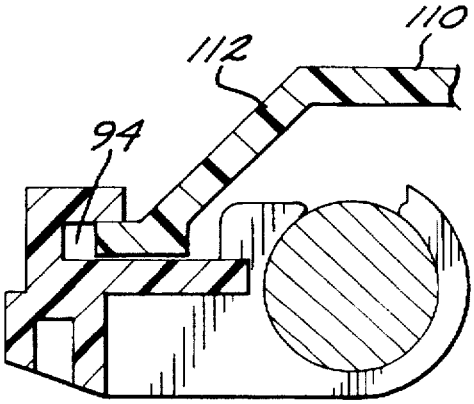
FIG. 8 is a cross-section view of the structure for holding the right edge of the platen in position, taken along line 8—8 of FIG. 3.

The platen 70 is mounted on the shaft of the drive roller 80 at platen C bushings 72 and 74. The roller shaft rotates on bearings 86A (FIG. 3) and 86B (FIG. 10). The platen includes an extending tab 92 on its right side, as seen in FIG. 3. The tab 120 is captured in one of two slots 120A, 120B (FIG. 4) formed in support structure 120. The structure 120 also includes a bearing support for the bearing 86B for supporting the left shaft end of the drive roller (FIGS. 9 and 10). The left side of the platen is supported on the roller shaft (FIG. 8), and its rotational position is stopped when the platen is in a print position by engagement of a rotation stop element 112 comprising the housing 110 in a slot 94 defined in the platen structure. Also illustrated in FIG. 8 is the supporting of the left end of the platen structure by the roller shaft. The opening in the platen structure through which the shaft 82 is received is sufficiently oversized in relation to the shaft diameter as to avoid substantial frictional forces.

FIG. 9 is a partially broken-away front view isolating on the right end of the platen 70 and its engagement with the structure 120. FIG. 10 is a cross-sectional view taken along line 10—10 of FIG. 9. The structure 120 is fixed to the printer chassis, and holds the bearing 86B affixed on the shaft. The tab 92 fits into the slot 120A with the platen in the print position, and into the slot 120B with the platen in a manual feed position.

Figure 4:
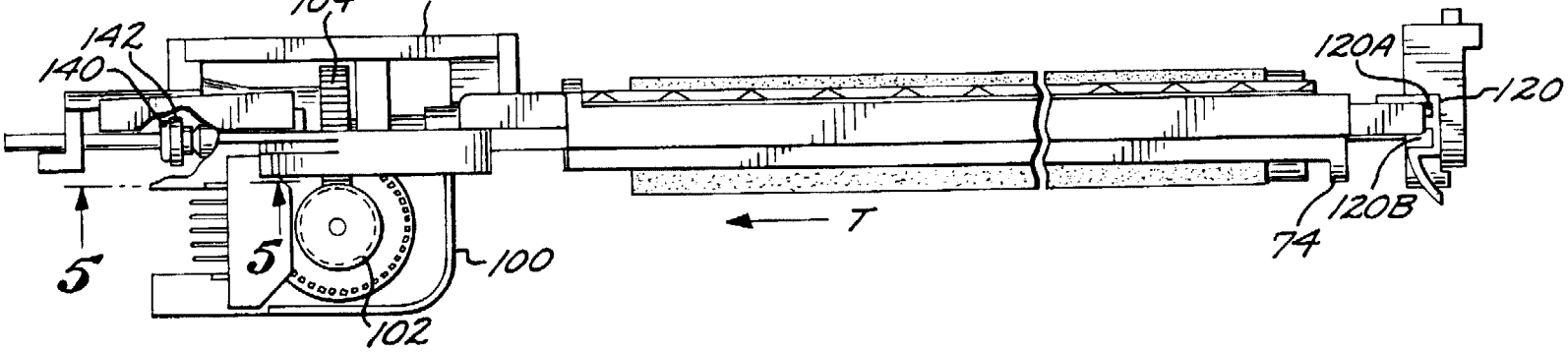
FIG. 4 is a front view of the motor drive and platen of FIG. 3.
Figure 5:
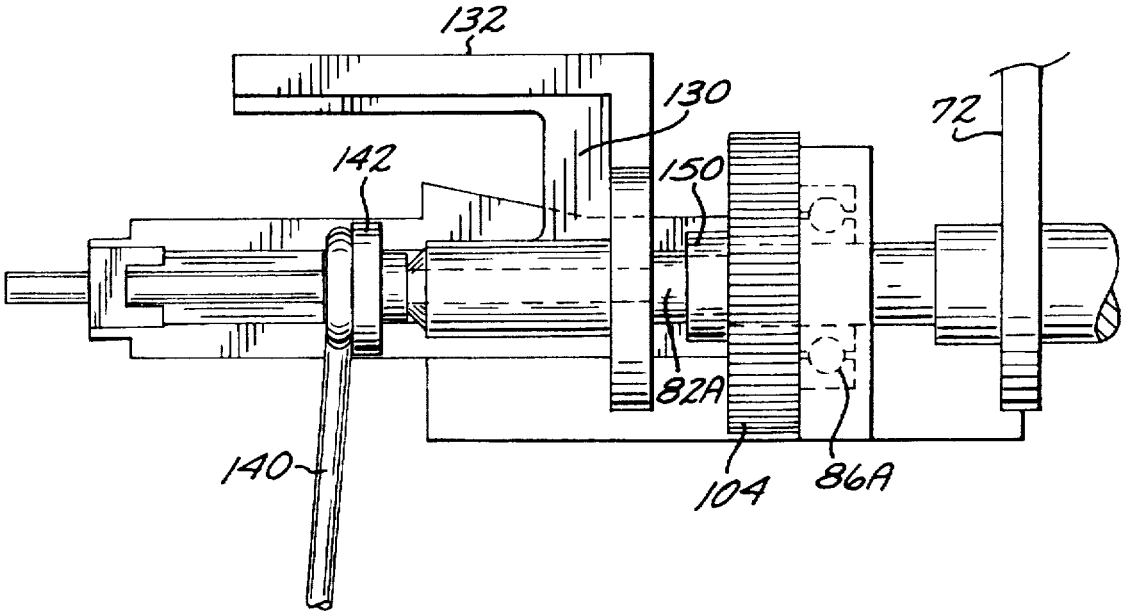
FIG. 5 is a bottom view of the left end of a portion of the drive roller and flag of the drive system of FIG. 3, as indicated by line 5—5 of FIG. 4.
Figure 6:
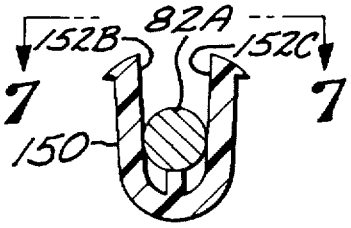
FIG. 6 is a cross-sectional view taken along line 6—6 of FIG. 3.
Figure 7:
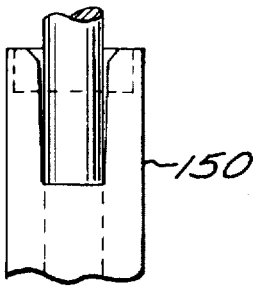
FIG. 7 is a top view of the structure of FIG. 6, taken from line 7—7 of FIG. 6.

A flag structure 130 is mounted on the roller shaft structure, and is translatable through a range of movement along the roller axis. A spring 140 biases the flag 130 toward the right, i.e. in the direction opposite to arrow T in FIG. 4, and thus will tend to keep the platen structure in engagement with the rotation stops provided by slots 120A and stop element 112. When the platen 70 is fully to the right end of its travel, the engagement with the rotation stops rotationally positions the platen a fixed distance from the print cartridge as shown in FIGS. 3 and 4. The platen in this position is disengaged from the roller, which is free to rotate for paper advancement during printing.

The platen 70 also has a tab 96 protruding toward the roller 80 adjacent the platen left end. The tab is engaged by a shoulder formed by boss 88 formed on the roller shaft (FIG. 3), when the platen is translated from right to left.

Figure 22:
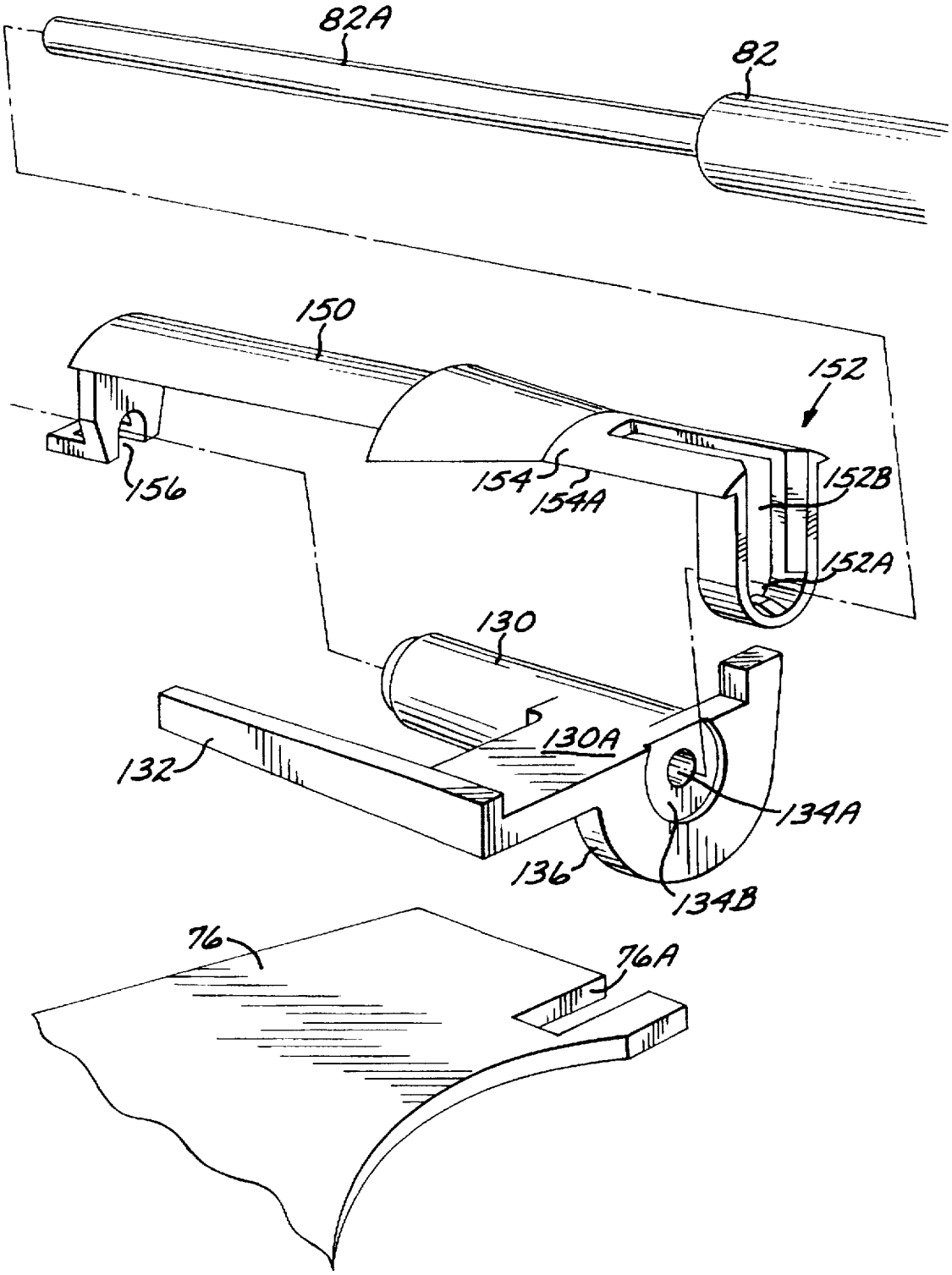
FIG. 22 is a perspective exploded view showing the key, flag and a portion of the platen structure.

The flag 130 is loosely fitted onto the roller shaft 82, so that the roller is free to turn without interference from the flag. A key structure 150 is also fitted on the roller drive shaft at its left end, and frictionally engages the shaft. FIG. 22 is an isometric view which illustrates in exploded view the flag 130, the key structure 150, structure of the platen 70 and the roller shaft structure at the left end of the roller shaft. The roller includes an aluminum shaft structure 82, with a steel shaft extension member 82A. The flag structure 130 includes the flag portion 132 and an axial bore 134A, having a countersunk region 134B at a first end thereof. The countersunk region is oversized with respect to the diameter of the aluminum shaft portion 82, and the axial bore is oversized with respect to the diameter of the steel shaft portion 82A. As a result, the flag structure turns freely on the roller shaft structure.

Also shown in FIG. 22 is a platform portion 76 defined by the left region 70B (FIG. 1) of the platen 70. The platform portion constrains the clockwise rotation of, and supports the flag 132 of the flag structure 130 with the platen in the print position. A relieved notch 76A is formed in the platform portion 76 to accept boss 136 of the flag structure. The purpose of the boss 136 and the notch 76A is to provide a translational engagement of the platen 70 with the flag structure 130, so that as the flag structure is translated to the left as described below, the platen is also pulled to the left as a result of the engagement of the boss with the platform portion 76.

The key structure 150 includes a first end slot structure 152, with a slot 152A defined by upright sides 152B, 152C (FIG. 8). The slot width is undersized with respect to the diameter of the aluminum shaft portion 82, providing a frictional engagement or "pinch" between the sides 150B, 150C and the shaft portion, such that a torque is produced in the direction of rotation whenever the drive roller rotates. The steel shaft portion 82A extends through the slot 152A and an opening 156 at the opposite end of the key structure. The key structure further includes a portion 154 having a flat under surface 154A. This surface is in contact with flat surface 130A of the flag structure.

With the frictional engagement of the key 150 on the shaft 82, the key will be urged to rotate with the shaft 82. During print operations with the platen in the print position and rotationally stopped, the platen is rotationally locked in the print position, and the platform portion 76 is also locked. Since the rotation of the shaft during printing is clockwise as viewed from the left shaft end, the platform holds the flag in place, which in turn holds the key in place, the key slipping on the shaft. If the shaft is turned in the reverse direction, i.e. counter-clockwise as viewed from the left shaft end, then there is no platform surface to prevent the key from turning counterclockwise. This would also rotate the flag counterclockwise, due to the engagement of the flat surfaces 154A and 130A.

FIGS. 11 and 12 are left side views of the platen, key and flag structures. FIG. 11 shows the position of the flag member 132 with the platen 70 in the print position. Here it can be seen that the flag 132 is below the print carriage 52, so that the flag will not engage the pen carriage. Next, in FIG. 12, the flag 132 has been raised by reverse rotation of the roller and the force applied through the key 150. In this position, the flag 132 is in a position to be engaged by the printer carriage 52 as it is moved to the left end of its range of travel.

Figure 13:
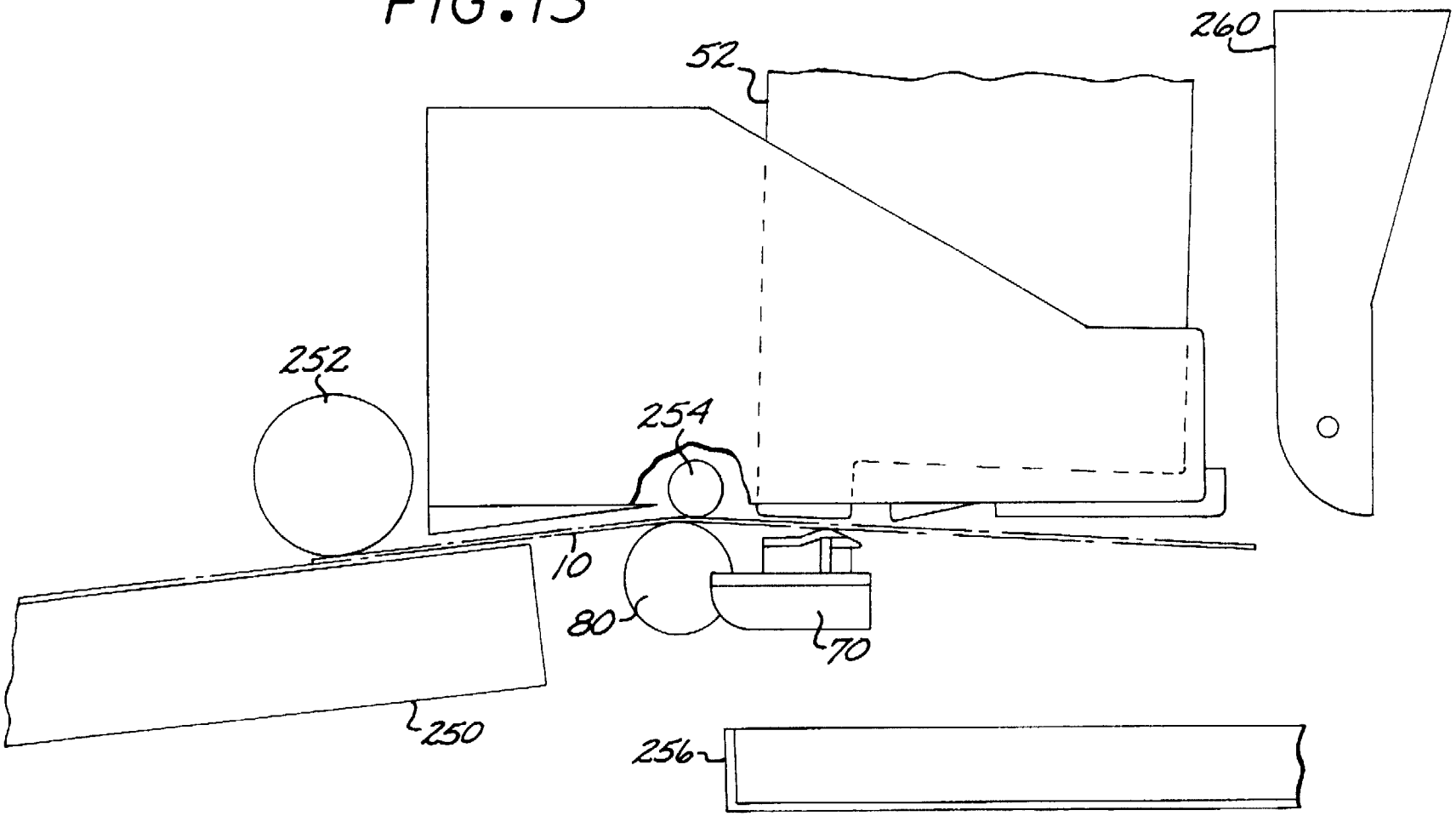
FIG. 13 is a simplified side view of the printer showing the paper path through the printer when in an automatic sheet feed mode.
Figure 14:
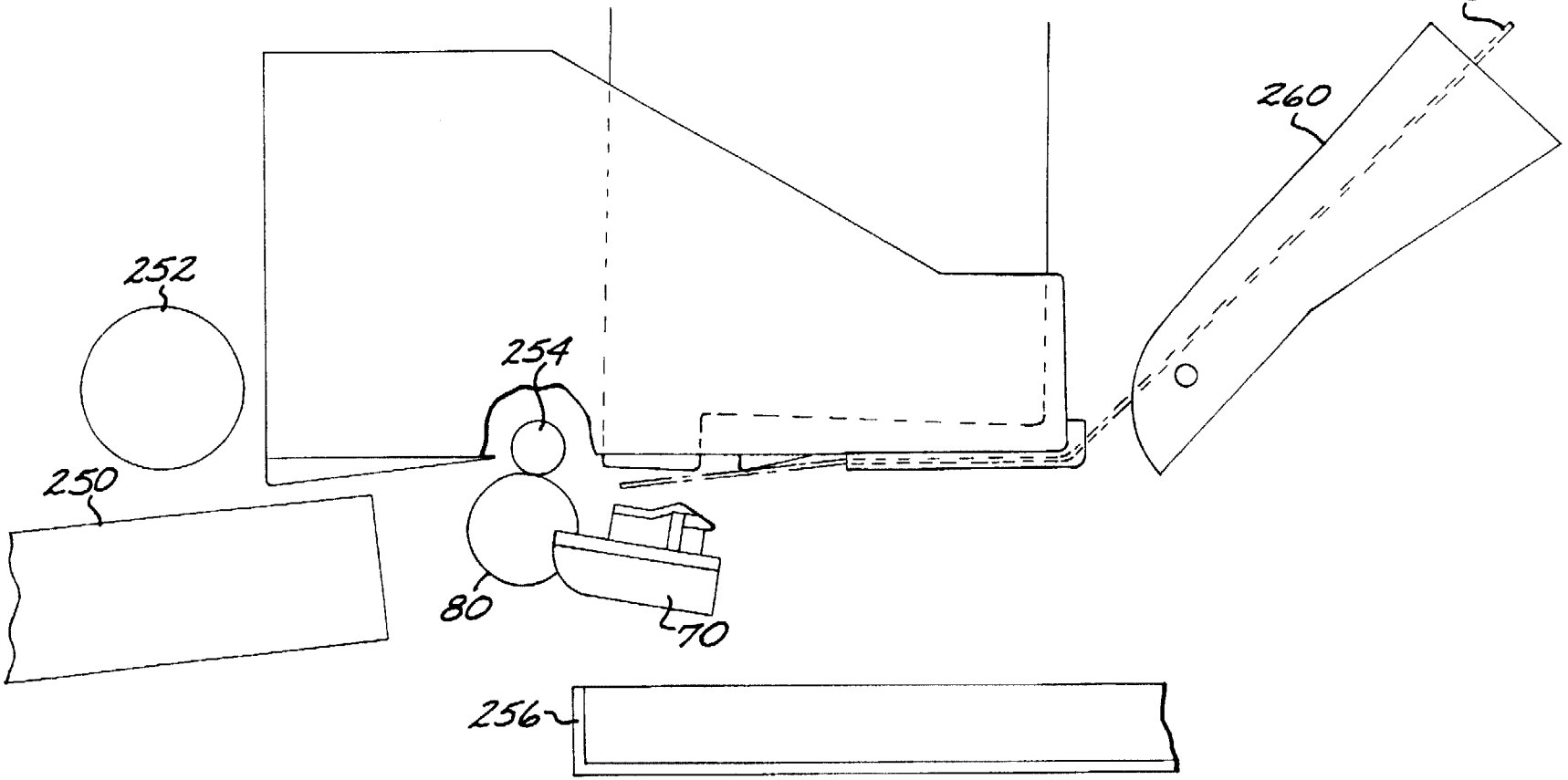
FIG. 14 is a simplified side view similar to FIG. 13, but showing the single sheet feed door assembly and platen rotated downwardly to permit a single sheet to be manually fed into the printer.

FIGS. 13 and 14 are simplified side views illustrating the media paths through the printer 50. In FIG. 13, there is shown an input tray 250 for holding a supply of fresh sheets of print media such as paper, and a pick roller 252 for engaging the top sheet 10 in the input tray and passing it along into the nip between the drive roller 80 and a pinch roller 254. The drive roller then advances the sheet 10 past the print area below the print carriage 52 and above the platen 70, where it can be ejected into an output tray 256, with the platen rotating downwardly as described above. A manual feed door assembly 260 is positioned as shown in FIG. 13 during this automatic feed mode of operation.

FIG. 14 shows an alternate feed path, wherein a sheet is manually passed along the door assembly 260 which has been pivoted down to the opened position as shown. The platen is placed in the manual feed position during the printer idle state, opening the feed aperture to receive the leading edge of the sheet. The opening size is somewhat exaggerated in FIG. 14 to illustrate this feature of the invention. A sensor (not shown) in the manual feed path alerts that printer processor that a manual feed sequence is to begin. The sheet is advanced into the nip between the drive roller 80 and pinch roller 254, with the drive roller being driven in reverse (counterclockwise) to draw the sheet past the print area, until the trailing edge reaches the print area, whereupon the drive roller motor is reversed again (clockwise), used to drop the platen, then reversed again (counterclockwise) to raise the platen to the manual feed position, and again reversed (clockwise) to rotate the roller counterclockwise as before to advance the sheet in the same manner described with regard to FIG. 13 for printing operations. At completion, the sheet is released, and the platen rotated downwardly to allow the sheet to drop into the output tray.

FIG. 15 is a simplified top view of the platen 70 and roller 80, showing the platen translated to the left as a result of engagement of the flag 132 by the printer carriage in the manner described with respect to FIG. 12. As the flag is pushed to the left, it carries the platen, translating the platen to the left. Now the platen is out of engagement with the rotation stops, and is free to drop down. FIG. 16 is a cross-sectional view along line 16—16 of FIG. 15, and shows the roller boss 88 with its semicircular configuration, defining the shoulder 88A. This shoulder engages against tab 96 of the platen (see FIG. 3 as well). The roller can now be rotated clockwise, forcing the platen to rotate clockwise, in the direction shown in FIG. 17. Now the platen 70 is disposed downwardly, and a sheet of print media at the print area can drop down into the output tray without interference from the platen. To bring the platen back up, the roller is driven in the reverse direction as shown in FIG. 18, and surface 88B of the roller boss 88 engages the tab 96, rotating the platen upwardly. If the platen is to be positioned in the manual feed position, the rotation will end at the position shown in FIG. 19. The carriage can be moved away from the left position out of engagement with the flag 132, and the spring 140 will move the platen into engagement again with the rotation stops, locking the platen in position for a manual feed operation. If the platen is to be returned to the print position, the reverse rotation of the roller is continued to place the platen in the position shown in FIG. 20, and the carriage can then be moved out of engagement with the flag to allow the flag and platen to move to the right, engaging the rotation stops.

Figure 21:
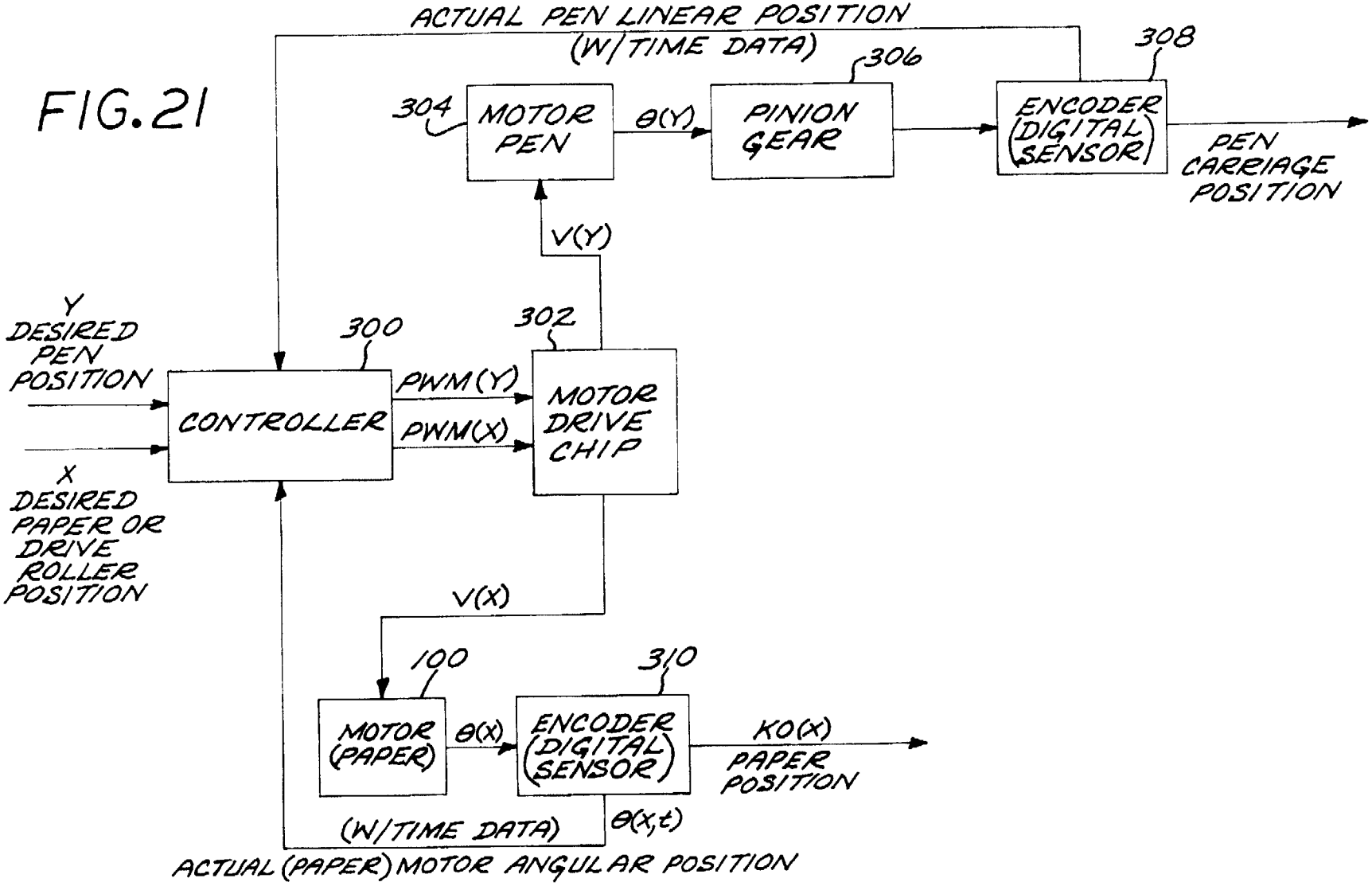
FIG. 21 is a simplified schematic block diagram of the printer controller and motor drive elements.

FIG. 21 illustrates a schematic block diagram of the control circuits for the roller and carriage drive systems used for the printer 50. The controller 300 receives input data, typically from the system processor, defining the desired pen (carriage) position Y, and the desired paper or drive roller position X. The processor converts this data into motor pulse width modulation signals (PWM(Y) and PWM(X)) which are used by the motor drive chip 302 to supply drive voltages to the carriage drive motor 404 and the roller drive motor 100. The motor 100 drives the gear 102 to move the drive roller 80. The motor 304 drives gear 306 to move the carriage 52. Encoders 306 and 308 monitor the actual gear movement to provide actual position signals as feedback to the controller 300.

A stacker activation sequence is executed anytime the platen is moved from one level to another. There are three platen levels. The first is the print position, the highest position. The platen is normally in this position only when printing, during auto sheet feeding from the internal paper supply held in the input tray, or during a paper edge sense mode. The manual feed position is a middle position, and it provides a larger opening in which to receive manually fed sheets, coming from the front of the printer through the manual feed door assembly. The drop position is the lowest level. The platen is normally in this position only when the paper is being dropped into the output tray, but may be left here when a fault occurs. The printer is normally left idling in the manual feed position. The stacker activation sequence includes the following steps:

(i) The drive roller moves in reverse, 14/80 revolutions in this exemplary embodiment. The flag 132 is raised as a result, and the shoulder in the roller shaft boss is oriented such that the tab 96 on the platen 70 can engage from any level.

(ii) The pen carriage is moved left to contact the flag 132.

(iii) The pen carriage, flag and key continue left until the right C bushing 74 on the platen is flush with the right side of the drive roller.

(iv) The drive roller moves the platen to a new level.

(v) the pen carriage moves right to the home position (FIG. 1). The flag, key and pen carriage all move right, disengaging the platen tab from the drive roller shoulder. The platen engages the rotation stops.

(vi) the drive roller moves forward, 14/80 revolutions, lowering the flag.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printer for producing hard copy, comprising:

a media path through a print area;

a pen carriage mounted for movement along a scan axis and transverse to the media path at the print area, the carriage holding a pen cartridge having a print head;

a carriage drive system for driving the pen carriage along the scan axis in response to drive signals;

a media drive system for driving the media along the media path in forward as well as in reverse directions in response to media drive signals;

a movable platen structure for providing a platen surface adapted to support the print media at the print area during printing operations at a platen print position and adapted for movement to a platen drop position to clear the platen surface away from the print medium upon completion of printing operations; and apparatus for activating the platen structure to move between said platen print position and said platen drop position, the activating apparatus including platen engaging apparatus positioned in a first position during printing operations to avoid interference with motion of the pen carriage, said platen engaging apparatus positioned in a second position which interferes with motion of the pen carriage and is engaged by the pen carriage to activate the platen structure for movement from the print position to the drop position.

2. The printer of claim 1 wherein the activation apparatus requires no added pen carriage travel for activation of the platen structure in addition to the travel needed for printing operations.

3. The printer of claim 1 wherein the media drive system includes a drive roller for engaging the print media, and a media drive motor system connected to the drive roller for rotating the roller in forward as well as reverse directions in response to the media drive signals.

4. The printer of claim 1 further including apparatus for applying torque to the platen structure when in the activation position in response to rotation of the drive roller, wherein the platen structure is carried by the roller during reverse rotation of the roller from the drop position to the print position.

5. The printer of claim 4 wherein the torque applying apparatus includes a key structure frictionally engaged by the roller during rotation of the roller, and the platen translation apparatus includes a flag structure to which torque is applied by the key structure, the flag structure rotationally mounted on the roller and adapted for rotation into the second position upon rotation of the roller in the reverse direction.

6. The printer of claim 1 wherein the activating apparatus further rotates the platen structure to a manual feed position intermediate the first position and the drop position to receive a sheet of media manually fed from a manual feed path.

7. A printer for producing hard copy, comprising:

a media path through a print area;

a pen carriage mounted for movement along a scan axis and transverse to the media path at the print area, the carriage holding a pen cartridge having a print head;

a carriage drive system for driving the pen carriage along the scan axis in response to drive signals;

a media drive system for driving the media along the media path in forward as well as in reverse directions in response to media drive signals;

a rotatable platen structure for providing a platen surface adapted to support the print media at the print area during printing operations and for rotating the platen structure on an axis to clear the platen surface away from the print medium upon completion of printing operations, the platen structure further being mounted for translation through a translation range of movement along said axis; and apparatus for activating the platen structure to rotate between a print position and a drop position, the activating apparatus including platen translation apparatus positioned in a first position during printing operations to avoid interference with motion of the pen carriage, said platen translation apparatus positioned in a second position which interferes with motion of the pen carriage and is engaged by the pen carriage to move the platen structure along the translation range of movement to a platen activation position to allow rotation of the platen from the print position to the drop position.

8. The printer of claim 7 wherein the activation apparatus requires no added pen carriage travel for activation of the platen structure in addition to the travel needed for printing operations.

9. The printer of claim 7 wherein the media drive system includes a drive roller for engaging the print media, and a media drive motor system connected to the drive roller for rotating the roller in forward as well as reverse directions in response to the media drive signals.

10. The printer of claim 7 further including apparatus for applying torque to the platen structure when in the activation position in response to rotation of the drive roller, wherein the platen structure is carried by the roller during reverse rotation of the roller from the drop position to the print position.

11. The printer of claim 10 wherein the torque applying apparatus includes a key structure frictionally engaged by the roller during rotation of the roller, and the platen translation apparatus includes a flag structure to which torque is applied by the key structure, the flag structure rotationally mounted on the roller and adapted for rotation into the second position upon rotation of the roller in the reverse direction.

12. The printer of claim 7 wherein the activating apparatus further rotates the platen structure to a manual feed position intermediate the first position and the drop position to receive a sheet of media manually fed from a manual feed path.

13. A printer for producing hard copy, comprising:

a media path through a print area;

a pen carriage mounted for movement along a scan axis and transverse to the media path at the print area, the carriage holding one or more pen cartridges each having a print head;

a carriage drive system for electrically driving the pen carriage along the scan axis in response to electrical drive signals;

a media drive system for driving the media along the media path, the drive system including a drive roller for engaging the print media, and a media drive motor system connected to the drive roller for rotating the roller in forward as well as in reverse directions in response to electrical media drive signals;

a rotatable platen structure mounted for rotation on the drive roller for providing a platen surface adapted to support the print media at the print area during printing operations and for rotating to clear the platen surface away from the print medium upon completion of printing operations, the platen structure further being mounted for translation through a translation range of movement along the roller axis;

engagable rotation stop structure for engaging the platen structure when the platen structure is positioned at a first position along the translation range of movement to hold the platen surface a predetermined distance from the print head of the pen cartridge during printing operation; and apparatus for activating the platen structure to rotate between a print position and a drop position, the apparatus including platen translation apparatus positionable in a first position which does not interfere with pen carriage movement, and positionable in a second position to be engagable by the pen carriage to move the platen structure along the translation range of movement to an activation position to disengage the rotation stop structure and thereby allow rotation of the platen structure.

14. The printer of claim 13 wherein the platen apparatus includes a flag member, and the activation apparatus includes a key structure frictionally engaging the roller for applying torque to the flag member to move from the first position to the second position upon rotation of the roller in the reverse direction.

15. The printer of claim 13 further including apparatus for applying torque to the platen structure when in the activation position in response to rotation of the drive roller, wherein the platen structure is carried by the roller during reverse rotation of the roller from the drop position to the print position.

16. The printer of claim 13 further including a second rotation stop structure for engaging the platen structure when the platen structure is positioned at a manual feed position along the translation range of movement to hold the platen surface at a position intermediate the first position and the drop position to receive a sheet of media manually fed from a manual feed path.

17. The printer of claim 13 wherein the activation apparatus requires no added pen carriage travel in addition to the travel needed for printing operations.

* * * * *